US005097613A

United States Patent [19]

Miller et al.

[11] Patent Number: 5,097,613

[45] Date of Patent: Mar. 24, 1992

[54] SAFETY PLUG FOR THE FIRING CHAMBER OF A WEAPON

[76] Inventors: Gary L. Miller, 4400 Northgate Dr., Knoxville, Tenn. 37938; Robert G. Plummer, 1008 Lovell View Dr., Knoxville, Tenn. 37922

[21] Appl. No.: 604,117

[22] Filed: Oct. 26, 1990

Related U.S. Application Data

[63] Continuation-in-part of Ser. No. 376,292, Jul. 6, 1989, Pat. No. 4,965,952.

[51] Int. Cl.[5] ..... F14H 17/44

[52] U.S. Cl. ..... 42/70.01; 42/105; 42/70.11

[58] Field of Search ..... 421/105, 70.01, 70.11, 421/46; 102/467

[56] References Cited

U.S. PATENT DOCUMENTS

| | | | |
|---|---|---|---|
| 2,294,822 | 9/1942 | Albree | 102/467 |
| 2,985,979 | 5/1961 | Doyle et al. | 42/96 |
| 3,193,959 | 7/1965 | Jaycox | 42/70.11 |
| 3,237,335 | 3/1966 | Kerr | 42/70.01 |
| 3,382,596 | 5/1968 | Rockwood | 42/70.11 |
| 4,092,794 | 6/1978 | Moren | 42/70.11 |
| 4,147,107 | 4/1979 | Ringdal | 102/467 |
| 4,603,498 | 8/1986 | Johnson | 42/70.11 |
| 4,802,298 | 2/1989 | Baugus | 42/70.11 |
| 4,835,894 | 6/1989 | Libassi | 42/70.11 |
| 4,965,952 | 10/1990 | Miller et al. | 42/70.11 |

*Primary Examiner*—Michael J. Carone
*Attorney, Agent, or Firm*—Pitts and Brittian

[57] ABSTRACT

A safety plug for the firing chamber of a weapon to provide a visual indication that the weapon firing chamber is free of live ammunition. The safety plug includes a cylindrical body having a diameter which is less than the weapon chamber bore. This body is rounded in the preferred embodiment at its forward end portion and fabricated from a non-abrasive material. A tab extends outwardly from the body such that it is visible when the firing chamber is closed to indicate a safe weapon. A button is carried by the rear end portion of the body. This button is preferably fabricated from a hardened material and can be readily engaged by the metal extractor of a conventional weapon for ejecting the plug in normal weapon operation. The plug can be used with a semi-automatic weapon in which the magazine is, or is not, inserted.

8 Claims, 1 Drawing Sheet

FIG. 1
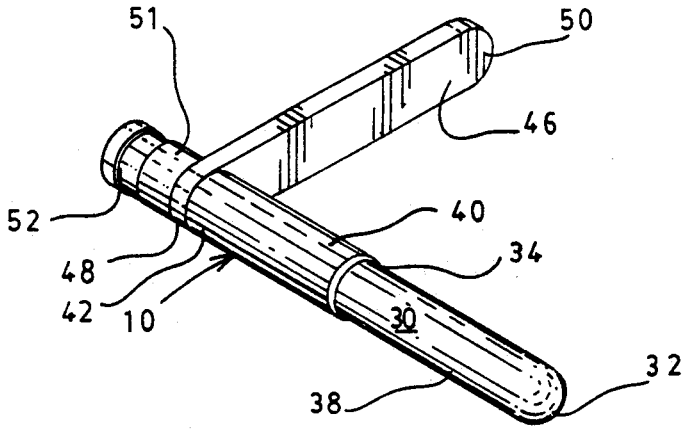
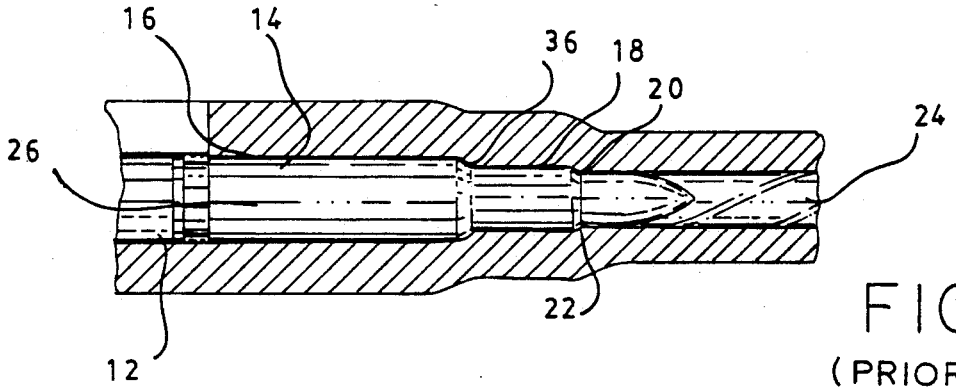
FIG. 2
(PRIOR ART)
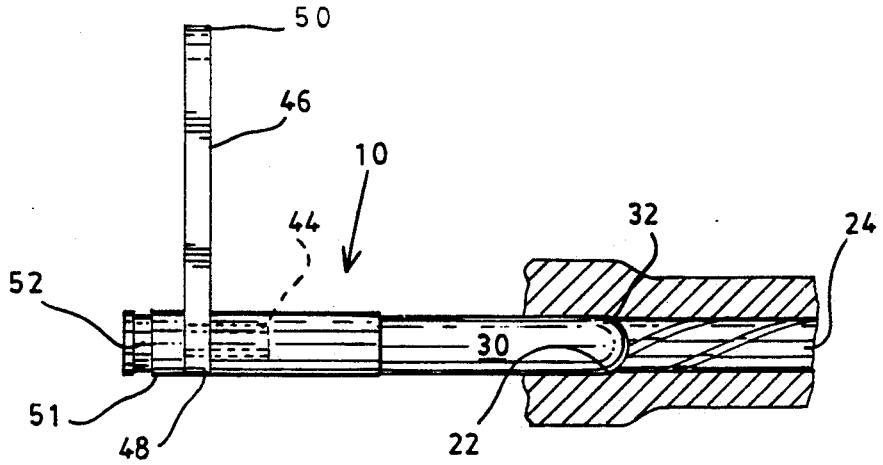
FIG. 3

SAFETY PLUG FOR THE FIRING CHAMBER OF A WEAPON

This is a continuation-in-part application based upon our earlier filed application, Ser. No. 07/376,292, filed July 6, 1989, now U.S. Pat. No. 4,965,952, issued Oct. 30, 1990.

DESCRIPTION

1. Technical Field

This invention relates to a safety plug, and more particularly concerns a safety plug which can be used in connection with semi-automatic weapons for providing a visual indication that the chamber is free of live ammunition.

2. Background Art

Safety mechanisms such as firing mode selectors are incorporated in the design of most semi-automatic weapons such as an M-16 rifle. Such weapons are accidentally fired by users who may be uncertain as to whether the weapon is in a loaded or unloaded condition. Conventionally, the firing chamber of a semi-automatic weapon must be opened and visually inspected before a carrier can determine if a live round of ammunition has been loaded into the firing chamber or chambered. The present invention alleviates the need of visually inspecting the firing chamber to determine if the weapon is loaded.

By way of comparison certain heretofore known safety plugs and similar devices are disclosed in U.S. Pat. Nos. 4,835,894; 4,603,498; 4,603,498; 4,147,107; 4,092,794; 3,382,596; 3,237,335; 2,985,979; and 2,294,822.

Accordingly, it is an object of the present invention to provide a plug for the firing chamber of a weapon, particularly semi-automatic weapons which is readily visible.

Another object of the invention is to provide such a visible plug which is retractable or which can be ejected from the weapon during normal weapon operation.

DISCLOSURE OF THE INVENTION

Other objects and advantages will be accomplished by the present invention which provides a safety plug for the firing chamber of a semi-automatic weapon. The safety plug includes a cylindrical body having a diameter which is less than the firing chamber bore. This body has a rounded front and is preferably fabricated from a non-abrasive material. A tab is mounted proximate the rear end of the body and extends from a closed firing chamber for visually indicating the weapon is closed. A button is mounted proximate the rear end of the body and is fabricated from a substantially rigid material. The button is engagable by a blot carrier and ejector of a standard semi-automatic weapon for injecting and ejecting the plug into and from, respectively, the firing chamber in normal weapon operation.

BRIEF DESCRIPTION OF THE DRAWINGS

Other objects and advantages of the present invention will become apparent upon reading the detailed description, together with the drawings in which:

FIG. 1 shows a safety plug constructed in accordance with various features of the present invention.

FIG. 2 illustrates the position of a live round of ammunition in the firing chamber of a conventional semi-automatic weapon with portions of the weapon not illustrated for purposes of illustration.

FIG. 3 illustrates a safety plug constructed in accordance with the present invention chambered in a semi-automatic weapon of conventional design.

BEST MODE FOR CARRYING OUT THE INVENTION

A safety plug for the firing chamber of a weapon is generally indicated at 10 in FIG. 1. This plug 10 is designed for being received within a conventional firing chamber 12 at the location a live round 14 of ammunition is positioned or chambered for firing. The firing chamber 12 includes a section generally indicated at 16 which holds the body of a conventional round of ammunition. The chamber is of a lesser dimension at the location indicated at 18. This section 18 of the chamber has a lesser diameter and receives the neck of a live round of ammunition or cartridge as is shown in FIG. 2. The lip of the neck 20 rests against the shouldered section of the chamber which opens into the rifled barrel 24. Thus, when a cartridge or live round of ammunition is chambered, it is in the position shown in FIG. 2 and readied for firing. It will be noted that the rearward portion of the round 14 is of conventional design and defines an annular recess which is engagable by the ejector of a conventional semi-automatic weapon which is used to discharge or eject the spent shell from the firing chamber. Moreover, the rearward portion 26 of the live round shell is also engaged by the bolt-carrier for chambering the live round into the position shown in FIG. 2.

The position of a live round in the firing chamber 12 having been described, the positioning of the safety plug 10 of the present invention in the firing chamber 12 can be understood. Referring to FIGS. 1 and 3, the safety plug 10 includes a cylindrical body 30 having a diameter which is less than the diameter of the firing chamber bore. This body 30 includes a rounded front end 32 which is proportioned for resting against the shouldered section 22 of the firing chamber which opens into the rifled barrel 24. By rounding the end portion 32, the particular tolerance of the safety plug can be increased thus reducing manufacturing cost. The body 30 is preferably fabricated from a non-abrasive material and is shouldered at the location indicated at 34. This shouldered location is designed for being positioned proximate the shouldered location 36 in the firing chamber 12 which opens into the section of the firing chamber of a lesser diameter that receives the neck of a cartridge as is shown in FIG. 2. Thus, in the preferred embodiment, the body 30 of the safety plug includes section 38 which is received within the portion of the firing chamber that receives the neck of a live round, and body section 40 which is received within the portion of the firing chamber in which the body of the shell is carried. It will be noted that section 40 has a diameter greater than the diameter of section 38 of the body. The body 30, and more specifically section 40 of the body 30, terminates in a rearward end portion 42 in the preferred embodiment. This rearward end portion is preferably flat as is shown in FIGS. 1 and 3, and is preferably provided with an internally threaded opening or bore 44 which opens onto the rearward end portion.

Means are provided for visually indicating the condition of a weapon being free of live ammunition. To this end, a suitable tab indicated at 46 extends outwardly from the rearward end 42 of the body 30 as is shown in FIGS. 1 and 3. This tab 46 is designed for extending from a closed firing chamber to visually indicate that the weapon firing chamber is free of live ammunition. It will be noted that the tab 46 is elongated and includes a first end portion 48 which is carried proximate the rearward end 42 of the body 30. The opposite end 50 of the tab is rounded in the preferred embodiment. The tab is preferably fabricated from a semi-rigid material such as nylon or the like which is non-abrasive and will not cause scaring of the firing chamber portion of the weapon.

In the preferred embodiment, the end portion 48 of the tab is provided with a suitable opening to assist in the releasable mounting the tab onto the rearward end 42 of the body 30 of the safety plug 10. However, it will be recognized that the tab 46 can be integrally formed with the body 30, if desired.

In accordance with one feature of the present invention, the safety plug is designed such that it can be injected and ejected, into and from the firing chamber during normal weapon operation. In this regard, a button generally indicated at 51 is provided. This button is designed to withstand the impact of loading the device or plug into the firing chamber of the weapon repeatedly and for being ejected from the firing chamber by a conventional semi-automatic extractor. In this regard, the button 51 is preferably fabricated from a substantially rigid material such as an aluminum alloy, anodized aluminum or the like. Further, in will be understood that certain strong, durable plastics, such as Kevlar, could be utilized. By thusly fabricating the button, it is able to withstand the impact and extraction forces occasioned by injecting and ejecting the plug. More specifically, when the safety plug is fully chambered, the bolt-carrier motion stops abruptly and substantially impacts the rearward portion of the button. Similarly, the extractor engages the button and it must be sturdy enough to withstand the extractor forces. To facilitate engagement with the extractor, it will be noted that the button 51 is provided with an annular recess 52 which is proportioned similar to the rearward end portion of a live round of ammunition such that the safety plug is engaged by the weapon extractor in a manner similar to the manner in which the spent shell is engaged during ejection.

In the preferred embodiment, the end portion 48 of the tab 46 is provided with a suitable opening through which an externally threaded member carried by the forward end portion of the button extends. The button is then threadably advanced such that the externally threaded portion of the button is received within the bore 44 for securing the tab, and the body, in assembly form. It will, of course, be recognized by those skilled in the art that other suitable means can be used for assembling the tab and button onto the body. In this regard, it will be recognized that the tap and the button can be integrally formed with the body if desired. Similarly, the button and the tab can be integrally formed and releasably secured to the body.

From the foregoing detailed description, it will be recognized that an improved safety plug for a firing chamber of a weapon has been provided. The safety plug is designed such that it can be used with the magazine in or out of a semi-automatic weapon. The safety plug is designed such that the length of the body approximates the length of a live round of ammunition. It includes a tab which extends substantially perpendicularly from the plug body such that it is visible and provides an indication that the weapon is free of live ammunition and safe. The plug is preferably fabricated along its body and tab from a non-abrasive material to assist in preventing weapon scaring. Further, the button of the present invention allows the plug to be quickly ejected if necessary, and the releasable securing of the button to the body in the preferred embodiment allows the button to be replaced if damaged.

While a preferred embodiment of a safety plug for the firing chamber of a weapon has been shown and described, it will be understood that there is no intent to limit the invention to such disclosure, but rather it is intended to cover all modifications and alternate constructions falling within the spirit and scope of the invention as defined in the appended claims and equivalents thereof.

We claim:

1. A safety plug for the firing chamber of a weapon comprising:

a cylindrical body having a diameter less than the firing chamber bore, a front end and a rear end;

a tab releasably secured to said rear end of said body for extending from a closed firing chamber for visually indicating the weapon firing chamber is free of live ammunition; and a button integrally formed with said tab and disposed proximate the rear end of said body so as to be rearward of said tab and so as to be releasably secured to said body in combination with said tab, said button being fabricated from a substantially rigid material, said button being engagable by a bolt-carrier and ejector of a standard semi-automatic weapon for injecting and ejecting the plug into and from, respectively, the firing chamber in normal weapon operation.

2. The safety plug of claim 1 wherein said cylindrical body has a rounded front end for engaging a shouldered opening into the rifled barrel of a conventional weapon.

3. The safety plug of claim 1 wherein said rear end of said body is flat, and wherein said tab includes one end portion mounted at said flat rear end of said body.

4. The safety plug of claim 1 wherein said tab is elongated and extends substantially perpendicular from said body.

5. The safety plug of claim 4 wherein said button is fabricated from an aluminum alloy capable of withstanding a plurality of ejections from said weapon occasioned by engagement with a weapon extractor.

6. The safety plug of claim 4 wherein said button is fabricated from a plastic material capable of withstanding a plurality of ejections from said weapon occasioned by engagement with a weapon extractor.

7. The safety plug of claim 1 wherein said button defines a rear end portion having an annular recess which is engaged by a conventional weapon extractor for ejecting said plug from the firing chamber of a weapon in normal weapon operation.

8. A safety plug for the firing chamber of a weapon, said safety plug comprising:

a cylindrical body having a diameter less than the firing chamber bore, a front end and a rear end;

a tab releasably secured to said rear end of said body for extending from a closed firing chamber for visually indicating the weapon firing chamber is free of live ammunition, and for selectively being grasped to facilitate insertion and extraction of said plug from said chamber; and a button integrally formed with said tab so as to be rearward of said tab and fabricated from a substantially rigid material, said button being engagable by a bolt-carrier and ejector of a standard semi-automatic weapon for facilitating the selective rapid ejection of said plug from said firing chamber in normal weapon operation, whereby said safety plug can be quickly removed from said firing chamber and replaced with a live round of ammunition without manual manipulation of said safety plug.

* * * * *